United States Patent [19]

Simo et al.

[11] Patent Number: 4,500,415

[45] Date of Patent: Feb. 19, 1985

[54] PROCESS OF CONVERTING NON-DISTILLABLE RESIDUES OF MIXED-BASE OR PARAFFIN-BASE CRUDE HYDROCARBON OILS

[75] Inventors: Thomas Simo, Bad Homburg; Karl-Heniz Eisenlohr, Buchschlag; Hans-Hermann Puxbaumer, Frankfurt am Main, all of Fed. Rep. of Germany

[73] Assignee: Metallgesellschaft Aktiengesellschaft, Frankfurt am Main, Fed. Rep. of Germany

[21] Appl. No.: 461,294

[22] Filed: Jan. 27, 1983

[30] Foreign Application Priority Data

Feb. 10, 1982 [DE] Fed. Rep. of Germany ..... 3204546

[51] Int. Cl.[3] ..... C10G 65/06; C10G 65/08; C10G 65/12

[52] U.S. Cl. ..... 208/56; 208/57; 208/59

[58] Field of Search ..... 208/56, 59, 111, 57

[56] References Cited

U.S. PATENT DOCUMENTS

| | | | |
|---|---|---|---|
| 3,541,169 | 11/1970 | Hicks, Jr. et al. | 208/56 |
| 3,730,876 | 5/1973 | Sequeira, Jr. | 208/59 |
| 3,755,141 | 8/1973 | Youngblood et al. | 208/56 |
| 4,115,246 | 9/1978 | Sweany | 208/56 |
| 4,294,686 | 10/1981 | Fisher et al. | 208/56 |
| 4,304,657 | 12/1981 | Miller | 208/135 |
| 4,309,276 | 1/1982 | Miller | 208/109 |
| 4,363,716 | 12/1982 | Greene et al. | 208/80 |

OTHER PUBLICATIONS

Olson et al., J. Catalysis 61, 1980, 390–396.

*Primary Examiner*—Delbert E. Gantz
*Assistant Examiner*—O. Chaudhuri
*Attorney, Agent, or Firm*—Sprung Horn Kramer & Woods

[57] ABSTRACT

A process is disclosed for converting a non-distillable residue of a mixed-base or paraffin-base crude hydrocarbon oil to a distillable precursor for motor fuels and/or petrochemical products which comprises donor solvent hydrovisbreaking said residue in a hydrovisbreaking zone in the presence of a circulated hydrogen donor solvent at a temperature in the range of 380° to 480° C. and at a pressure in the range of 40 to 200 bars said circulated hydrogen donor solvent having been produced in said process by distilling the product from said hydrovisbreaking to separate the hydrogenated liquid hydrocarbons into a plurality of fractions, withdrawing a branch stream and subjecting said branch stream to a catalytic treatment in the presence of molecular hydrogen, whereby aromatic compounds in said branch stream are converted by a selective catalytic hydrogenation to naphthenic compounds and paraffins are converted by a selective catalytic cracking to naphtha fractions which boil below the boiling range of hydrogen donor solvent.

12 Claims, 1 Drawing Figure

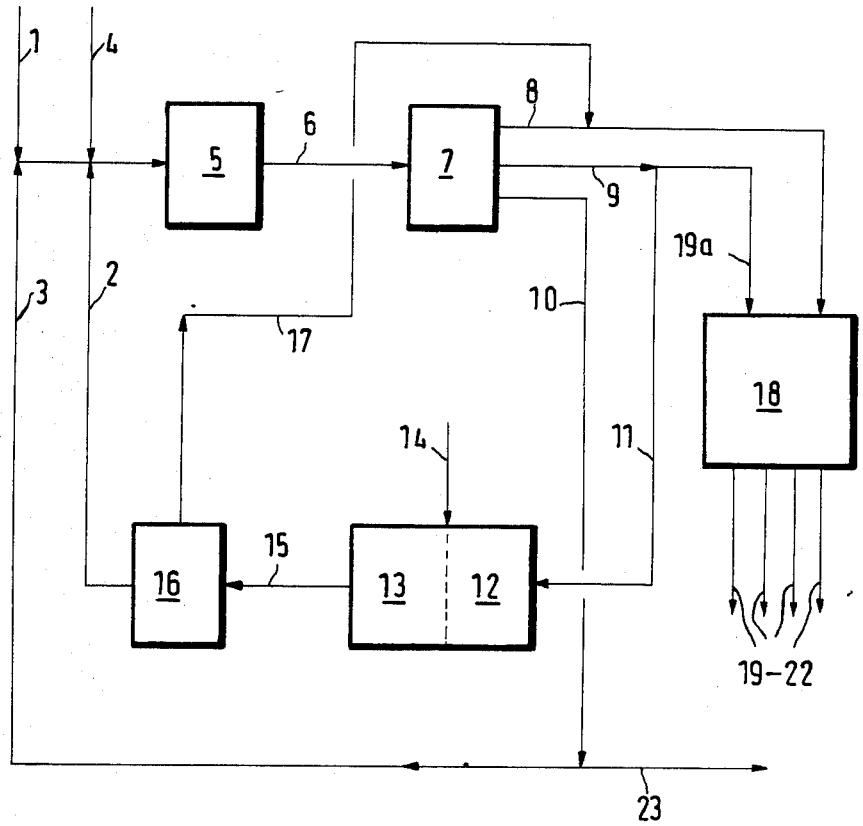
1
4
5
6
7
8
9
19a
3
2
10
17
18
14
11
15
16
13
12
19–22
23

PROCESS OF CONVERTING NON-DISTILLABLE RESIDUES OF MIXED-BASE OR PARAFFIN-BASE CRUDE HYDROCARBON OILS

BACKGROUND OF THE INVENTION

Field of the Invention

This invention relates to a process of converting non-distillable residues of mixed-base or paraffin-base crude hydrocarbon oils to distillable precursors for motor fuels and/or petrochemical products by donor solvents hydrovisbreaking at temperatures of 380° to 480° C. and pressures of 40 to 200 bars in the presence of a circulated hydrogen donor solvent which has been produced in the same process and in the presence of hydrogen and by a succeeding distillation to separate the hydrogenated liquid hydrocarbons into a plurality of fractions.

It is known that heavy hydrocarbon oils having a high content of non-distillable residues can be processed by treating the heavy hydrocarbon oil to elevated temperatures and superatmospheric pressures, if desired, in the presence of dispersed solids, with molecular hydrogen and a circulated hydrogen donor oil. The process can be performed such that a certain proportion of the asphaltenes adsorbed to the solids are coked. Thereafter, the product of that donor solvent hydrovisbreaking (DSV) is distilled, the distillate or distillates is or are catalytically hydrogenated, the visbreaker residue is made available for the production of hydrogen, and the hydrogenated products are divided into fractions, which are processed further to form motor fuels and/or petrochemical products (see German Offenlegungsschrift 29 20 415).

It is also known to carry out the treatment of the crude oil near the coking limit in the presence of hydrogen donor components which have been derived from the crude oil itself or from a similar crude oil or from the visbreaker distillate (see German Offenlegungsschrift 29 49 935).

These known processes can be used to produce, under steady-state conditions, from naphthenic crude oils a hydrogen donor solvent having the approximate composition C (aliphatic) up to 50%, C (naphthenic) at least 35%, and C (aromatic) at least 15% and having a boiling range from 200° to 500° C. Owing to its good hydrogen-transferring properties, that product may be recycled to the hydrovisbreaker. The hydrogen donor solvent acts not only to maintain or even improve the asphaltenes in colloidal solution in the raw material to be processed but also makes the hydrogen available under the prevailing reaction conditions at a rate which at any time substantially matches the rate at which the raw material is hydrogenated. As a result, the recombination of the hydrogen radicals to form molecular hydrogen is minimized. Owing to these properties, the recycling of the hydrogen donor solvent to the hydrovisbreaker permits a conversion of the starting residue of more than 90% and while permitting use of such small amounts of donor solvent compared to the starting residue that undesired isomerization of the hydrogen-transferring components is avoided.

However, in the conversion of non-distillable residues of mixed-basic or paraffinic crude hydrocarbon oils, a hydrogen donor solvent having the desired composition and desired properties cannot be produced and circulated in the same process because under steady-state conditions the concentration of aromatic and naphthenic compounds are too low and the concentration of aliphatic compounds is too high.

It is an object of the invention, therefore, to provide a process for hydrogen donor solvent visbreaking which avoids these disadvantages of the prior art and ensures very low concentrations of aromatic and napthenic compounds so that a hydrogen donor solvent of high quality is obtained which when recycled to the hydrovisbreaking process permits an optimum conversion of non-distillable residues of mixed-basic or paraffin-basic crude hydrocarbon oils to form useful precursors for use in the production of power or of raw materials.

SUMMARY OF THE INVENTION

This object is accomplished, according to the invention, which produces a hydrogen donor solvent from that part of the distillate produced by hydrovisbreaking which is withdrawn as a branch stream and is subjected to a catalytic treatment in the presence of molecular hydrogen. Such distillate is treated by a selective catalytic hydrogenation whereby aromatic compounds are selectively converted to naphthenic compounds and paraffins are converted by selective catalytic cracking to naphtha fractions which boil below the boiling range of the hydrogen donor solvent.

In one embodiment of the invention, the catalysts used for the selective hydrogenation consist of Ni and Mo on a support of $Al_2O_3$ and the catalysts used for the selective cracking comprises molecular sieves, especially naturally and synthetic zeolites.

The molecular sieves which are used preferably have pores with dimensions between 4 and 7 Angstroms and contain components for increasing the cracking activity. In a preferred embodiment of the invention, the molecular sieves which are used are zeolites of Type ZSM-5 or UHP-Y, particularly in combination with a matrix which contains $Al_2O_3$.

Molecular sieves comprising Silicalite, which is a product consisting of crystalline silicon dioxide, with or without a matrix which contains $Al_2O_3$ may also be used within the scope of the invention.

The catalytic treatment is preferably carried out in a plurality of stages under hydrogenating conditions.

In another embodiment of the invention, the treatment is carried out in two stages, a catalyst consisting of Ni and Mo on a support of $Al_2O_3$ is used in the first stage and a catalyst consisting of Ni and Mo on a molecular sieve which contains an $Al_2O_3$ matrix is used in the second stage.

Both catalsyts are known per se and have been described, e.g., in German Offenlegungsschrift No. 30 10 094, U.S. Pat. No. 4,061,724, and European Application No. 80,304,036 (Publication No. 0,028,938).

Owing to the use of a catalyst comprising Ni and Mo on a support which contains a molecular sieve and of a matrix which contains $Al_2O_3$, i.e., of a multi-functional catalyst, the paraffins are cracked and the hydrogenation is completed in the second stage.

According to the invention, both stages can be carried out in a common hydrogenating reactor.

It is preferred to use a temperature of 360° to 430° C. in the first catalytic stage and a temperature of 340° to 420° C. in the second stage whereas the total pressure in both stages may be the same and amount, e.g., to 50 to 180 bars.

Alternatively, different total pressures may be used in the two stages. For instance, the total pressure may amount to 100 to 150 bars in the first stage and to 40 to 80 bars in the second stage.

Within the scope of the invention, the gas-liquid ratio which is used suitably amounts to 400 to 800 $m^3$ STP per metric ton of liquid feedstock and the space velocity of the liquid feedstock is suitably maintained between 0.5 and 1.5 kg/l.h.

The advantages afforded by the invention over known proposals, such as that disclosed in U.S. Pat. No. 3,147,206, reside particularly in that the selective catalytic cracking of the paraffins, particularly of the n-paraffins, can be integrated into the selective catalytic hydrogenation of the aromatic compounds. Another advantage afforded by the invention resides in that the restrictions of the performance of the donor solvent hydrovisbreaking, which depend on the nature of the raw material to be treated, are eliminated and the efficiency of hydrogen transfer is greatly improved.

BRIEF DESCRIPTION OF DRAWING

The invention is illustrated diagramatically in the accompanying flow diagram and in the examples. The process is described more fully hereinafter.

DESCRIPTION OF SPECIFIC EMBODIMENT

For the sake of clarity, certain devices or apparatus parts which are obvious to a person skilled in the art, such as pumps or other conveying or handling means, gas liquid separators, gas circulation systems, heat exchangers etc. have not been shown in the drawing. Moreover, the apparatus or apparatus parts which will be mentioned may be used in different combinations or in a different sequence within the scope of the invention.

Referring to the flow diagram, the crude oil residue 1 together with donor solvent 2 and recycled residue 3 is fed to the hydrovisbreaker 5 in the presence of hydrogen 4. The liquid product 6 of the hydrovisbreaker 5 is separated in the distilling unit 7 into naphtha 8 boiling below 200° C., medium and vacuum distillates 9 boiling at 200°-500° C. and hydrovisbreaker residue 10. Part of the hydrovisbreaker distillate having a boiling range from 200° to 500° C. is used as a feedstock 11 for the production of hydrogen donor solvent. For this purpose that part is subjected to a selective catalytic hydrogenation in 12 and subsequently to a selective catalytic cracking of paraffins in 13 or to a cracking of paraffins and a completion of the hydrogenation with the aid of a multifunctional catalyst. Stages 12 and 13 are suitably combined in a hydrogenating reactor, which is fed with molecular hydrogen via line 14.

The following conditions, for instance, are maintained in the catalytic stage 12:

| | |
|---|---|
| Catalyst | Ni—Mo (sulfides) on $Al_2O_3$ |
| Temperature | 380 to 410° C. |
| Total Pressure | 70 to 140 bars |
| Space Velocity (liquid feedstock) | 0.5 to 1.0 kg/l · h |
| Gas-liquid ratio | 400 to 600 $m^3$ STP per metric ton |

In addition to the selective catalytic hydrogenation of the aromatic compounds, a saturation of olefins and a substantial removal of heteroatoms are effected.

The following conditions, for instance, are maintained in 13:

| | |
|---|---|
| Catalyst | Molecular sieve (Silicalite), with $Al_2O_3$ matrix as support and Ni—Mo (sulfides) as a hydrogenating component (multifunctional catalyst) |
| Temperature | 360 to 400° C. |
| Total pressure | 70 to 140 bars (as in 12) |
| Space velocity (liquid feedstock) | 0.5 to 1.5 kg/l · h |
| Gas-liquid ratio | 400 to 600 $m^3$ STP per metric ton (as in 12) |

In this stage the paraffins are selectively cracked and the selective hydrogenation of the aromatic compounds is completed at the same time.

Effleunt hydrogen (from stages 12, 13) from which the liquid product 15 has been separated can suitably be fed as fresh hydrogen 4 to the hydrovisbreaker 5. In that case the recirculation of hydrogen for stages 12 and 13 can be partially or entirely omitted.

In the distilling unit 16, the liquid product 15 is separated into the naphtha stream 17 and the donor solvent 2. A mixture of stream 17 with the hydrovisbreaker naphtha 8 can be processed further in the refinery 18 to produce a motor gasoline component or the stream 17 may be used preferably separately to produce ethylene. The main stream 19*a* of the 200°-500° C. distillates from which the circulating donor solvent stream 11 has been branched off can be processed further to form refinery products 19 to 22 which are commercially available. The residue 10 is partly recycled as stream 3 to the hydrovisbreaker 5 and partly discharged as stream 23 consisting of concentrated metal impurities and other inorganic impurities.

In order to more fully illustrate the invention and the manner of practicing the same, the following examples are presented:

EXAMPLE 1

A vacuum distillation residue 1 derived from light Arabian crude oil and having a boiling point above 500° C. was processed. In the hydrovisbreaker 5, the residue 1 was treated at a temperature of 430° C. and a total pressure of 140 bars with hydrogen donor solvent 2 and recycled residue 3 in the presence of hydrogen-containing, recycled gas 4. The hydrogenated liquid product 6 was withdrawn and hydrogenated in 7. The hydrovisbreaker distillate 9 had the following properties:

| | |
|---|---|
| Boiling range | 200 to 500° C. |
| Density (g/ml) | 0.9070 at 20° C. |
| Elementary analysis (% by weight) | H 11.80<br>C 85.4<br>S 2.4 |
| Molecular weight (g/mole) | 280 |
| Bromine number (g/100 g) | 16 |
| Constitution (%) | C (aliphatic compounds) 56<br>C (naphthenic compounds) 19<br>C (aromatic compounds) 25 |

Part of this distillate was supplied as a stream 11 to the donor solvent-producing unit. The following conditions were maintained in the first hydrogenating stage 12:

| | |
|---|---|
| Catalyst | Ni—Mo (sulfides) on $Al_2O_3$ |
| Temperature (maximum) | 410° C. |
| Total pressure | 140 bars |

-continued

| | |
|---|---|
| Space velocity | 1 kg/l · h |
| Hydrogen | 400 l STP per kg of liquid feedstock |

The liquid effluent from the hydrogenating stage contained 7% by weight naphtha 17, boiling below 200° C. The fraction boiling at 200° to 500° C. had the following properties:

| | |
|---|---|
| Density | 0.8530 at 20° C. |
| Elementary analysis | H 13.10 |
| (% by weight) | C 86.6 |
| | S 0.001 |
| Molecular weight (g/mol) | 270 |
| Bromine number (g/100 g) | 1 |
| Constitution (%) | C (aliphatic compounds) 59 |
| | C (naphthenic compounds) 30 |
| | C (aromatic compounds) 11 |

The entire liquid effluent was fed to the second hydrogenating stage 13, in which the following conditions were maintained:

| | |
|---|---|
| Catalyst | Molecular sieve (Silicalite) with $Al_2O_3$ as a matrix and Ni—Mo (sulfides) as a hydrogenating component (multifunctional catalyst) |
| Temperature | 390° C. |
| Total Pressure | 140 bars |
| Space Velocity | 1 kg/l · h |
| Hydrogen | 300 l STP per kg liquid feedstock |

The effluent stream 15 contained 25% by weight naphtha boiling below 200° C. The 200°–500° C. fraction 2 (donor solvent) had the following properties:

| | |
|---|---|
| Density (g/ml) | 0.8610 at 20° C. |
| Elementary analysis | H 13.05 |
| (% by weight) | C 86.4 |
| | S 0.001 |
| Molecular weight (g/mol) | 290 |
| Bromine number (g/100 g) | 1 |
| Constitution (%) | C (aliphatic compounds) 45 |
| | C (naphthenic compounds) 40 |
| | C (aromatic compounds) 15 |

EXAMPLE 2

The process was carried out as in Example 1 with the difference that the first hydrogenating stage 12 was operated at a total pressure of 140 bars and the second hydrogenating stage 13 at a total pressure of 70 bars. The recovered donor solvent had the following properties:

| | |
|---|---|
| Boiling range | 200 to 500° C. |
| Density (g/ml) | 0.8630 at 20° C. |
| Elementary analysis | H 12.9 |
| (% by weight) | C 86.5 |
| | S 0.0005 |
| Molecular weight (g/mol) | 295 |
| Bromine number (g/100 g) | 1 |
| Constitution (%) | C (Aliphatic compounds) 41 |
| | C (naphthenic compounds) 43 |
| | C (aromatic compounds) 16 |

The naphtha fraction 17 boiling below 200° C. amounted to 28% by weight of stream 11.

EXAMPLE 3

The vacuum distillation residue of a light Arabian crude oil was used as feedstock 1 for the entire process. The following quantitative proportions were maintained in the feedstock for the hydrovisbreaking 5:

| | |
|---|---|
| Vacuum distillation residue 1 | 100 parts by weight |
| Hydrogen donor solvent 2 | 25 parts by weight |
| Vacuum distillation residue | 20 parts by weight |

The donor solvent production of donor solvent was produced under the conditions stated in Example 1.

Under steady-state conditions, 80% of the vacuum distillation residue feedstock were converted to the following fractions boiling below 500° C.:

| | |
|---|---|
| Inorganic gases | 4.0% by weight of feedstock |
| $C_1$ to $C_4$ hydrocarbons | 4.8% by weight of feedstock |
| Fraction $C_5$–200° C. | 18.0% by weight of feedstock |
| Fraction 200–500° C. | 55.8% by weight of feedstock |
| Residue boiling above 500° C. | 19.4% by weight of feedstock. |

What is claimed is:

1. A process for converting a non-distillable residue of a mixed-base or paraffin-base crude hydrocarbon oil to a distillable precursor for petrochemical products including motor fuels which comprises donor solvent hydrovisbreaking said residue in a hydrovisbreaking zone in the presence of a circulated hydrogen donor solvent at a temperature in the range 380° to 480° C. and at a pressure in the range of 40 to 200 bars and producing a liquid product, separating said liquid product by a first distillation into a naphtha fraction boiling below 200° C., a medium fraction boiling at 200° to 500° C. and a residue fraction boiling above 500° C., subjecting a branch stream of said medium fraction to a catalytic treatment in the presence of molecular hydrogen, said treatment comprising a selective catalytic hydrogenation followed by a selective catalytic cracking, said selective catalytic hydrogenation being conducted to such an extent as to selectively hydrogenate aromatic compounds to naphthenic compounds, the catalyst of said selective cracking being silicalite molecular sieve with a pore diameter in at least one dimension between 4 and 7 Angstroms, by said selective catalytic cracking paraffins are converted to naphtha fractions boiling below the boiling range of said hydrogen donor solvent, separating the product from said catalytic treatment by a second distillation into a naphtha fraction boiling below 200° C. and a higher boiling fraction with a boiling range of 200° to 500° C., said higher boiling fraction being solely used as said hydrogen donor solvent, the bromine number of said hydrogen donor solvent being the same as the bromine number of the fraction boiling at 200° to 500° C. of the product of said selective hydrogenation.

2. A process according to claim 1, wherein the catalyst employed for the selective hydrogenation comprises Ni and Mo on a support of $Al_2O_3$.

3. A process according to claim 2, wherein said molecular sieve contains hydrogenation metals.

4. A process according to claim 1, wherein said silicalite is disposed within a matrix containing $Al_2O_3$.

5. A process according to claim 1, wherein said silicalite is free of a matrix.

6. A process according to claim 1, wherein said selective catalytic hydrogenation of aromatic compounds to naphthenic compounds and selective catalytic cracking of paraffins to naphtha compounds is carried out in a plurality of stages under hydrogenation conditions.

7. A process according to claim 6, wherein all stages are carried out in a common hydrogenating reactor.

8. A process according to claim 6, wherein there is a first stage which contains a catalyst comprising nickel and molybdenum on an alumina support and a second stage comprising a catalyst which comprises nickel and molybdenum on said silicalite which silicalite is disposed in an aluminum matrix and the temperature of said first stage is 360° to 430° C. and the temperature of said second stage is 340° to 420° C.

9. A process according to claim 8, wherein the total pressure in the first and second stages is 50 to 180 bars.

10. A process according to claim 8, wherein a total pressure of 100 to 150 bars is utilized in the first stage and a total pressure of 40 to 80 bars is utilized in the second stage.

11. A process according to claim 1, wherein 400 to 800 cubic meters STP of gas are employed in said hydrovisbreaking zone per metric ton of liquid feedstock.

12. A process according to claim 1, wherein the space velocity of liquid feedstock to said hydrovisbreaking zone is 0.5 to 1.5 kg/l.h.

* * * * *